US010215132B2

(12) United States Patent
Dudar

(10) Patent No.: US 10,215,132 B2
(45) Date of Patent: Feb. 26, 2019

(54) SYSTEMS AND METHODS FOR A FUEL VAPOR CANISTER HEATING ELEMENT

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 792 days.

(21) Appl. No.: 14/924,450

(22) Filed: Oct. 27, 2015

(65) Prior Publication Data

US 2017/0114732 A1 Apr. 27, 2017

(51) Int. Cl.

| | |
|---|---|
| ***F02M 25/08*** | (2006.01) |
| *F02D 41/04* | (2006.01) |
| *F02D 41/22* | (2006.01) |
| *F02D 41/00* | (2006.01) |

(52) U.S. Cl.

CPC .... *F02M 25/0836* (2013.01); *F02M 25/0809* (2013.01); *F02M 25/0854* (2013.01); *F02D 41/0035* (2013.01); *F02D 41/042* (2013.01); *F02D 41/221* (2013.01); *F02M 2025/0881* (2013.01)

(58) Field of Classification Search

CPC ..... F02M 25/0836; F02M 25/0854; F02M 25/0809; F02M 2025/0881; F02D 41/221; F02D 41/0035; F02D 41/042

See application file for complete search history.

(56) References Cited

U.S. PATENT DOCUMENTS

| | | | | |
|---|---|---|---|---|
| 5,465,614 | A | 11/1995 | Fournier | |
| 5,880,361 | A | 3/1999 | Taniguchi | |
| 6,581,580 | B2 | 6/2003 | Trumpy et al. | |
| 6,689,196 | B2 | 2/2004 | Amano et al. | |
| 2004/0237637 | A1 | 12/2004 | Veinotte et al. | |
| 2008/0041226 | A1* | 2/2008 | Hiltzik | B01D 53/0438 95/90 |
| 2015/0120110 | A1* | 4/2015 | Yang | B60K 6/20 701/22 |
| 2016/0138528 | A1* | 5/2016 | Burleigh | F02M 25/0809 123/520 |
| 2016/0341156 | A1* | 11/2016 | Yang | F02M 25/0854 |
| 2018/0058384 | A1* | 3/2018 | Dudar | F02D 41/221 |

OTHER PUBLICATIONS

"Delphi Hybrid Evaporative Emissions Canister Module," Delphi, http://delphi.com/manufacturers/auto/hevevproducts/evap-emiss-sys/hybrid-evap-can-mod/, pp. 1-2, Accessed Jan. 12, 2016.

* cited by examiner

*Primary Examiner* — Hung Q Nguyen
*Assistant Examiner* — Xiao Mo
(74) *Attorney, Agent, or Firm* — Julia Voutyras; McCoy Russell LLP

(57) ABSTRACT

A method is presented, wherein a fuel vapor canister heating element is activated during a first condition, which includes an engine-off condition, and atmospheric air is directed through the fuel vapor canister and into an engine intake. Degradation of the fuel vapor canister heating element is indicated based on an output of an engine intake air temperature sensor. In this way, the integrity of the fuel vapor canister heating element can be determined without relying on canister temperature sensors, which may be confounded by the cooling of the fuel vapor canister during fuel vapor desorption.

20 Claims, 5 Drawing Sheets

SYSTEMS AND METHODS FOR A FUEL VAPOR CANISTER HEATING ELEMENT

FIELD

The present description relates generally to methods and systems for controlling a vehicle evaporative emissions system to determine the integrity of a fuel vapor canister heating element.

BACKGROUND/SUMMARY

Vehicle emission control systems may be configured to store fuel vapors from fuel tank refueling and diurnal engine operations in a fuel vapor canister containing an adsorbent, such as activated carbon. The stored vapors may then be purged from the canister during a subsequent engine operation. The purged vapors may be routed to engine intake for combustion, further improving vehicle fuel economy.

Fuel vapor adsorption by activated carbon is an exothermic reaction; the canister experiences an increase in temperature during canister loading. Conversely, fuel vapor desorption is endothermic, cooling the canister during purge events. Thus, a cool fuel vapor canister may have enhanced adsorption capacity, while a hot fuel vapor canister may have an increased ability to desorb fuel vapor. As such, heating the adsorbent is employed as a strategy to promote desorption and increase purge efficiency. Canister heating elements may directly heat the adsorbent, may heat the exterior of the canister, and/or may heat purge air passing through the canister. However, as part of the evaporative emissions system a canister heating element may be subject to periodic testing in order to meet emissions standards and regulations.

Other attempts to address canister heating element function include placing one or more thermocouples within the canister adsorbent bed. One example approach is shown by Hiltzik et al. in U.S. Patent Application 2008/0041226. Therein, selective regions of the canister are heated using electrical heating devices, while performance of the canister is monitored using thermocouples along the purge air flow path. However, the inventors herein have recognized potential issues with such systems. As an example, adding thermocouples incurs additional cost and complexity. Further, as part of the evaporative emissions system, any canister temperature sensors are also subject to additional diagnostic tests as part of emissions regulations.

In one example, the issues described above may be addressed by a method wherein a fuel vapor canister heating element is activated during a first condition, which includes an engine-off condition, and atmospheric air is directed through the fuel vapor canister and into an engine intake. Degradation of the fuel vapor canister heating element is indicated based on an output of an engine intake air temperature sensor. In this way, the integrity of the fuel vapor canister heating element can be determined without relying on canister temperature sensors, which may be confounded by the cooling of the fuel vapor canister during fuel vapor desorption.

As one example, a reversible vacuum pump coupled within an evaporative leak check module may be activated in a pressurizing mode to direct atmospheric air into the heated canister. Thus, the function of the canister heating element may be discerned using existing elements of the evaporative emissions system.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
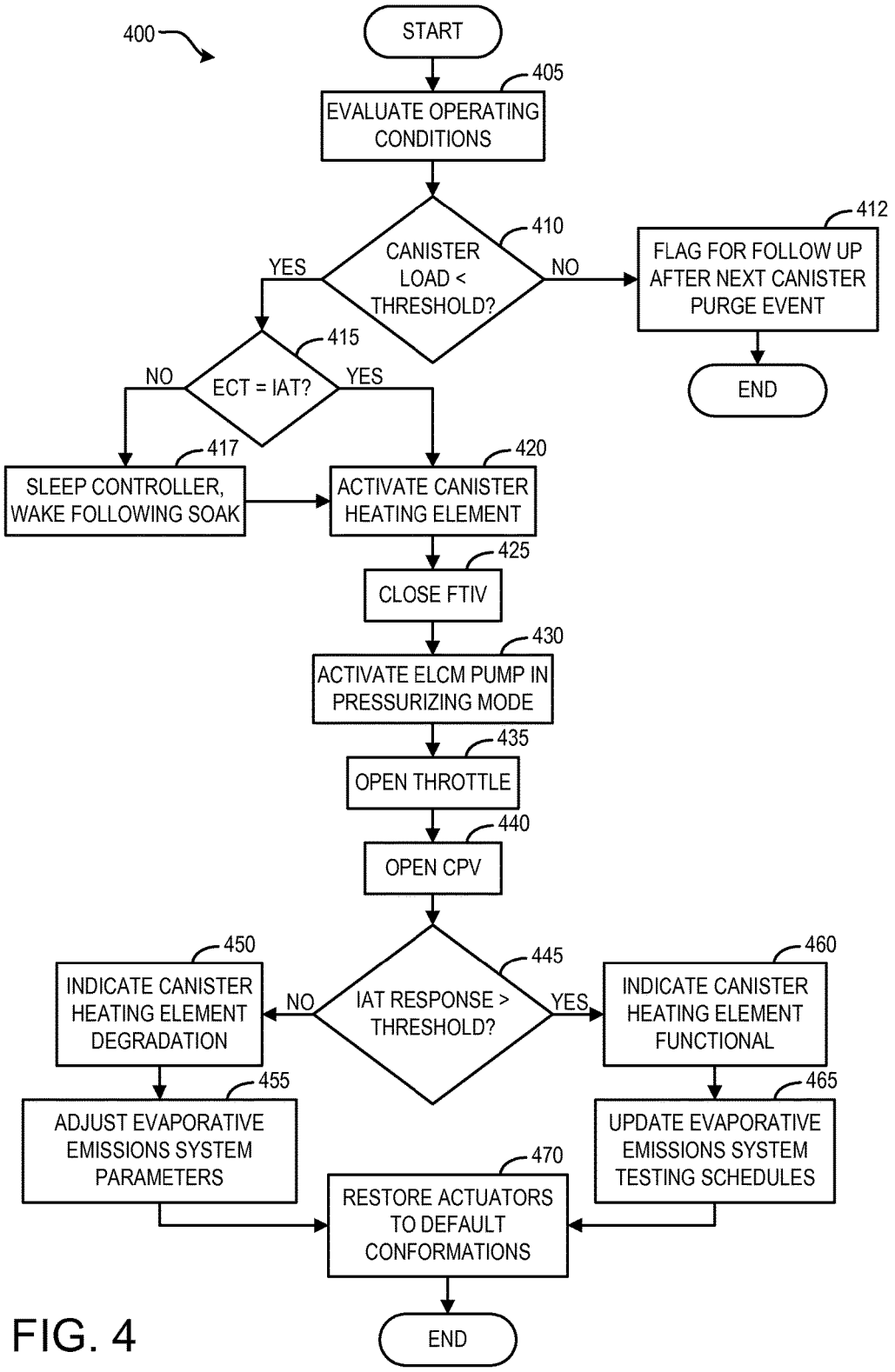
FIG. 4 is a flow chart for a high-level method for determining the integrity of a fuel vapor canister heating element.
Figure 5:
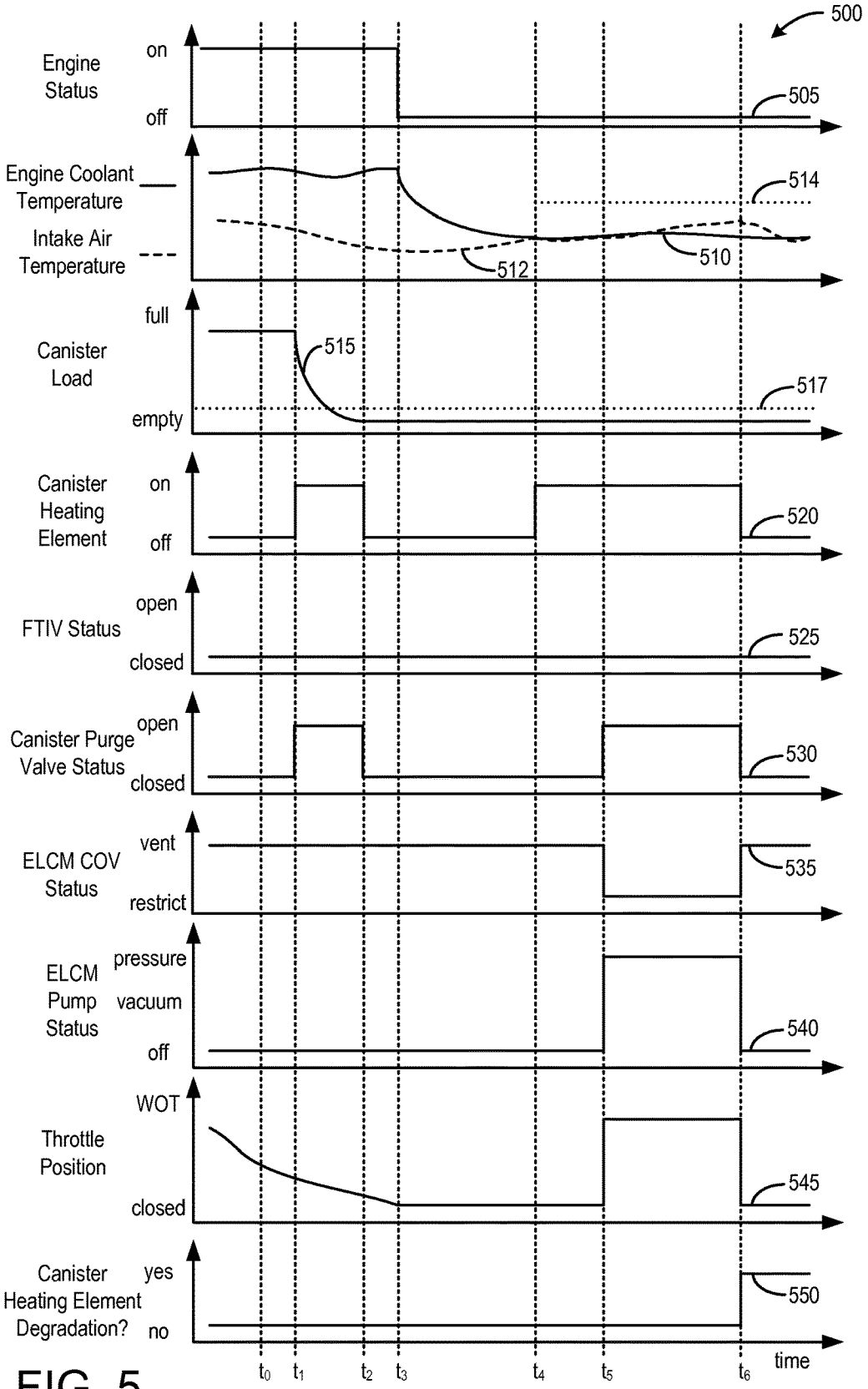
FIG. 5 shows a timeline for an example fuel vapor canister heating element integrity test.

The following description relates to systems and methods for determining the integrity of a fuel vapor canister heating element. In particular, the heating element may be tested during an engine off condition, wherein the heating element is activated, and atmospheric air is forced through the fuel vapor canister. A temperature sensor located downstream of the fuel vapor canister is then monitored for an increase in temperature, signifying that the air forced through the canister has been heated. The systems and methods herein may be implemented in a vehicle with a hybrid powertrain, such as the propulsion system depicted in FIG. 1. For vehicles which have limited engine run time, increasing the efficiency of canister purging can increase the performance of the vehicle's evaporative emissions system, which may be coupled to the vehicle fuel system and engine system, as depicted in FIG. 2. Such an evaporative emissions system may include an evaporative leak check module, comprising a vacuum pump that may be utilized to draw a vacuum on the fuel system during testing for undesired evaporative emissions. In some examples, the vacuum pump may be reversible and capable of pressurizing the fuel system as well as drawing a vacuum. Configurations and conformations for an exemplary evaporative leak check module are depicted in FIGS. 3A-3D. During an engine-off condition, such as following a vehicle-off soak, when the fuel vapor canister has been recently purged and the engine has cooled to ambient temperature, the fuel vapor canister heating element may be tested. As shown in FIG. 4, the heating element may be activated, and then atmospheric air may be pumped through the fuel vapor canister. The air may then be routed to engine intake, where the output of an intake air temperature sensor is monitored for change. As shown in FIG. 5, this method may be used to indicate degradation of the fuel vapor canister heating element.

Figure 1:
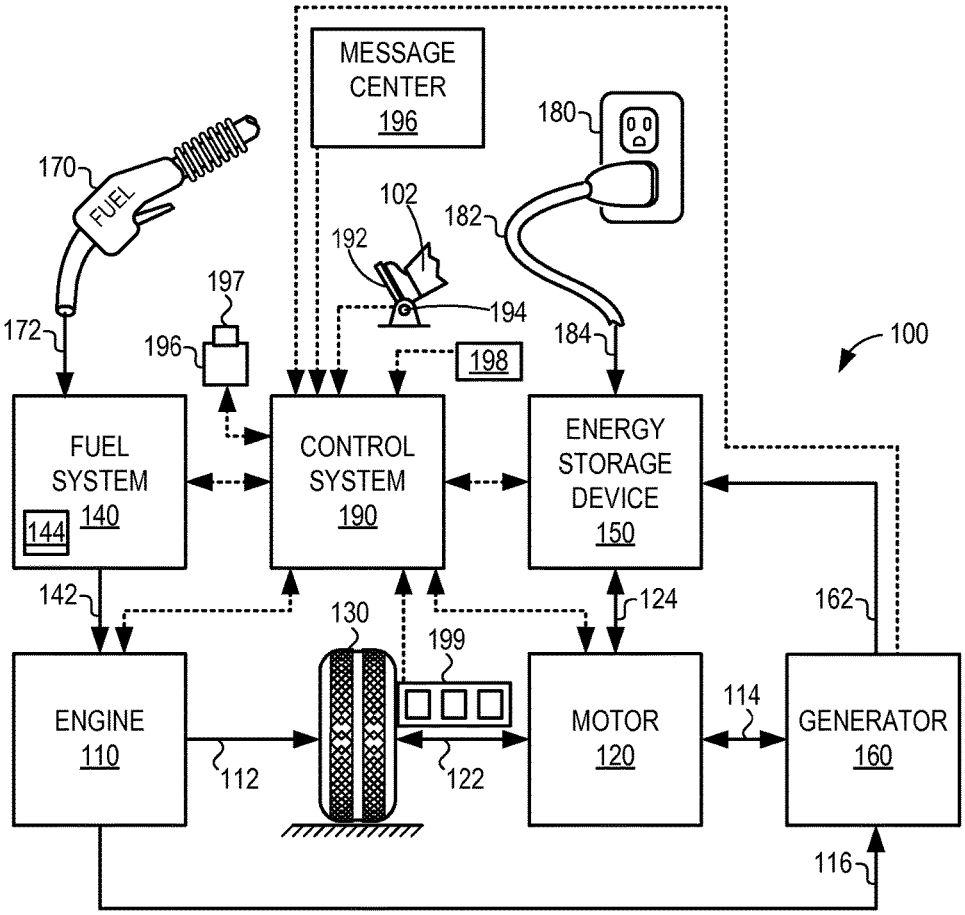
FIG. 1 schematically shows an example vehicle propulsion system.
Figure 2:
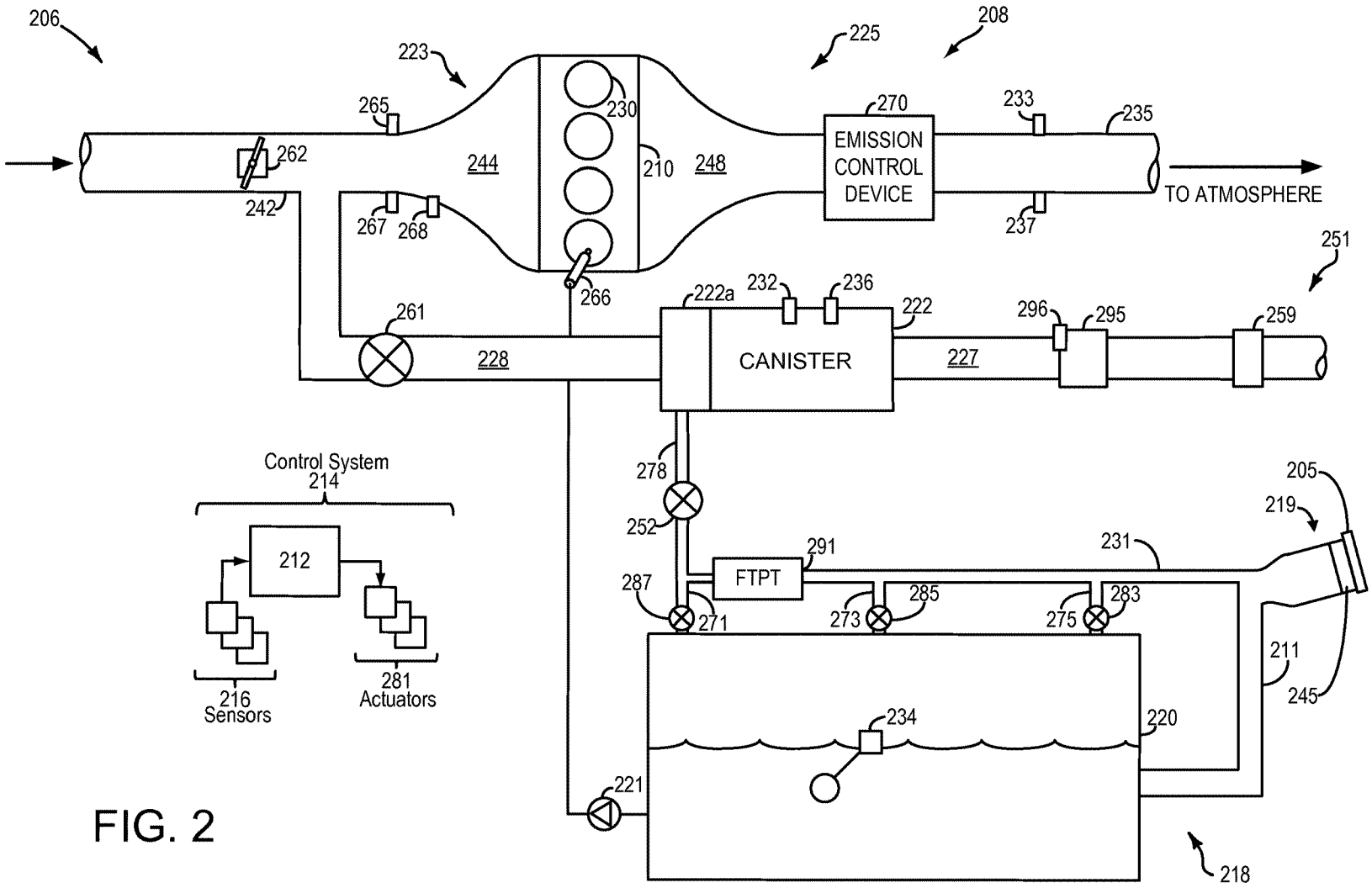
FIG. 2 schematically shows an example vehicle system comprising an engine system coupled to a fuel system and an evaporative emissions system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors. For example, a manifold adjusted pressure (MAP) sensor 265, an intake air temperature (IAT) sensor 267, and/or a manifold air flow (MAF) sensor 268 may be coupled to engine intake 223, while exhaust temperature sensor 233 and exhaust gas oxygen sensor 237 may be coupled to engine exhaust 225.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits 278 and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves are provided in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283 The one or more vent valves may be electronically or mechanically actuated valves and may include active vent valves (that is, valves with moving parts that are actuated open or close by a controller) or passive valves (that is, valves with no moving parts that are actuated open or close passively based on a tank fill level). Based on a fuel level in the fuel tank 220, the vent valves may be open or closed. For example, GVV 287 may be normally open allowing for diurnal and "running loss" vapors from the fuel tank to be released into canister 222, preventing over-pressurizing of the fuel tank. However, during vehicle operation on an incline, when a fuel level as indicated by fuel level indicator 34 is artificially raised on one side of the fuel tank, GVV 287 may close to prevent liquid fuel from entering vapor recovery line 231. As another example, FLVV 285 may be normally open, however during fuel tank refilling, FLVV 285 may close, causing pressure to build in vapor recovery line 231 as well as at a filler nozzle coupled to the fuel pump. The increase in pressure at the filler nozzle may then trip the refueling pump, stopping the fuel fill process automatically, and preventing overfilling.

Further, in some examples, vapor recovery line 231 may be coupled to a refueling system 219. In some examples, refueling system 219 may include a fuel cap 205 for sealing off the fuel filler system from the atmosphere. Refueling system 219 is coupled to fuel tank 220 via a fuel filler pipe or neck 211. Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister. Further, one or more canister heating elements 236 may be coupled to and/or within canister 222. Canister heating element 236 may be used to selectively heat the canister (and the adsorbent contained within) for example, to increase desorption of fuel vapors prior to performing a purge operation. Heating element 236 may comprise an electric heating element, such as a conductive metal, ceramic, or carbon element that may be heated electrically, such as a thermistor. In some embodiments, heating element 236 may comprise a source of microwave energy, or may comprise a canister jacket coupled to a source of hot air or hot water. Heating element 236 may be coupled to one or more heat exchangers that may facilitate the transfer of heat, (e.g., from hot exhaust) to canister 222. Heating element 236 may be configured to heat air within canister 222, and/or to directly heat the adsorbent located within canister 222. In some embodiments, heating element 236 may be included in a heater compartment coupled to the interior or exterior of canister 222. In some embodiments, canister 222 may be coupled to one or more cooling circuits, and/or cooling fans. In this way, canister 222 may be selectively cooled to increase adsorption of fuel vapors (e.g., prior to a refueling event). In some examples, heating element 236 may comprise one or more Peltier elements, which may be configured to selectively heat or cool canister 222.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

Flow of air and vapors between canister 222 and the atmosphere may be regulated by a canister vent valve (not shown) which may be a normally open valve, so that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere via canister vent valve 229, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252 while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas oxygen sensor 237 located upstream of the emission control device, temperature sensor 233, fuel tank pressure sensor 291, fuel level sensor 234, MAP sensor 265, intake air temperature sensor 267, and canister temperature sensor 232. Other sensors such as pressure, temperature, air/fuel ratio, and composition sensors may be coupled to various locations in the vehicle system 206. As another example, the actuators may include fuel injector 266, throttle 262, fuel tank isolation valve 252, ELCM 295, and refueling lock 245. The control system 214 may include a controller 212. The controller may receive input data from the various sensors, process the input data, and trigger the actuators in response to the processed input data based on instruction or code programmed therein corresponding to one or more routines. An example control routine is described herein with reference to FIG. 4.

Undesired evaporative emission detection routines may be intermittently performed by controller 212 on fuel system 218 to confirm that the fuel system is not degraded. As such, undesired evaporative emission detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, undesired evaporative emission detection routines may be performed while the engine is running by operating a vacuum pump and/or using engine intake manifold vacuum. Undesired evaporative emission tests may be performed by an evaporative leak check module (ELCM) 295 communicatively coupled to controller 212. ELCM 295 may be coupled in vent 227, between canister 222 and the atmosphere. ELCM 295 may include a vacuum pump configured to apply a negative pressure to the fuel system when in a first conformation, such as when administering a leak test. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, undesired evaporative emissions from the fuel system may be identified. The ELCM vacuum pump may be a reversible vacuum pump, and thus configured to apply a positive pressure to the fuel system when a bridging circuit is reversed placing the pump in a second conformation.

Figure 3C:
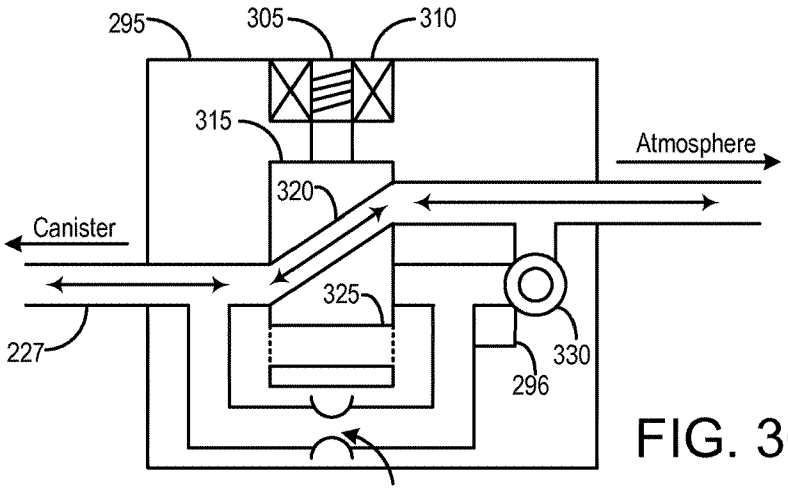
FIG. 3C shows a schematic depiction of an evaporative leak check module in a configuration where a fuel vapor canister is vented to atmosphere.
Figure 3A:
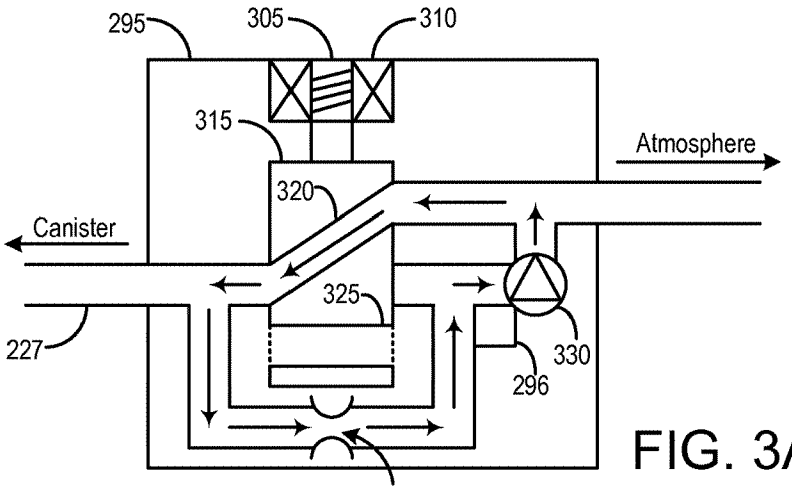
FIG. 3A shows a schematic depiction of an evaporative leak check module in a configuration to apply a vacuum to a reference orifice.
Figure 3D:
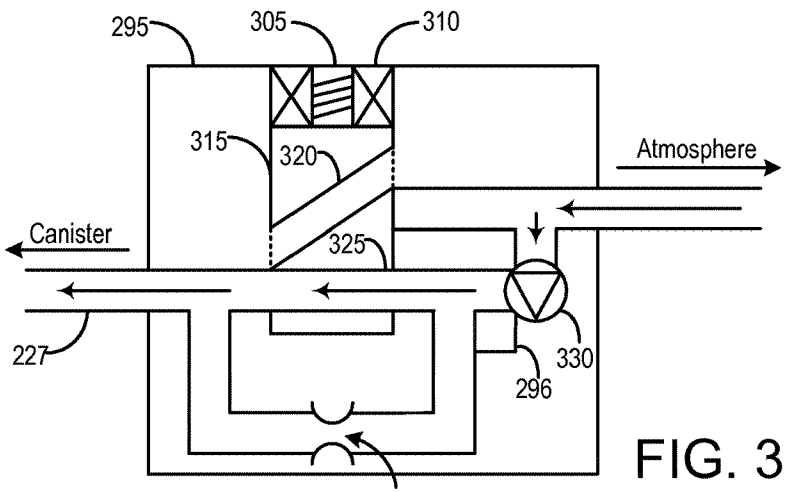
FIG. 3D shows a schematic depiction of an evaporative leak check module in a configuration to apply positive pressure to an evaporative emissions system.
Figure 3B:
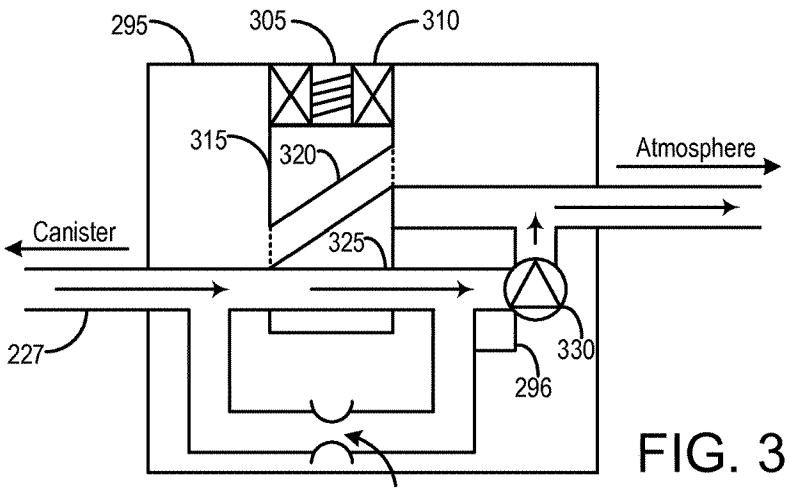
FIG. 3B shows a schematic depiction of an evaporative leak check module in a configuration to apply a vacuum to an evaporative emissions system.

FIGS. 3A-3D show a schematic depiction of an example ELCM 295 in various conditions and conformations in accordance with the present disclosure. As shown in FIG. 2, ELCM 295 may be located along vent 227 between canister 222 and atmosphere. ELCM 295 includes a changeover valve (COV) 315, a vacuum pump 330, and a pressure sensor 296. Vacuum pump 330 may be a reversible pump, for example, a vane pump. The direction of vacuum generation by pump 330 may be reversed by an H-bridge circuit, or other suitable means of reversing pump polarity. COV 315 may be moveable between a first a second position. In the first position, as shown in FIGS. 3A and 3C, air may flow through ELCM 295 via first flow path 320. In the second position, as shown in FIGS. 3B and 3D, air may flow through ELCM 295 via second flow path 325. The position of COV 315 may be controlled by solenoid 310 via compression spring 305. ELCM 295 may also comprise reference orifice 340. Reference orifice 340 may have a diameter corresponding to the size of a threshold leak to be tested, for example, 0.02". In either the first or second position, pressure sensor 296 may generate a pressure signal reflecting the pressure within ELCM 295. Operation of pump 330 and solenoid 310 may be controlled via signals received from controller 212.

As shown in FIG. 3A, COV 315 is in the first position, and pump 330 is activated in a first direction. In this conformation, ELCM 295 may perform a reference check. For example, fuel tank isolation valve 252 (not shown) may be closed, isolating ELCM 295 from the fuel tank. Air flow through ELCM 295 in this configuration is represented by arrows. In this configuration, pump 330 may draw a vacuum on reference orifice 340, and pressure sensor 296 may record the vacuum level within ELCM 295. This reference check vacuum level reading may then become the threshold for passing/failing a subsequent undesired evaporative emissions test.

As shown in FIG. 3B, COV 315 is in the second position, and pump 330 is activated in the first direction. This configuration allows pump 330 to draw a vacuum on fuel system 218 via vent line 227. In examples where fuel system 218 includes FTIV 252, FTIV 252 may be opened to allow pump 330 to draw a vacuum on fuel tank 220. Air flow through ELCM 295 in this configuration is represented by arrows. In this configuration, as pump 330 pulls a vacuum on fuel system 218, the absence of undesired evaporative emissions from the system should allow for the vacuum level in ELCM 295 to reach or exceed the previously determined vacuum threshold using reference orifice 340. In the presence of an evaporative emissions system breach larger than the reference orifice, the pump will not pull down to the reference check vacuum level, and undesired evaporative emissions may be indicated.

As shown in FIG. 3C, COV 315 is in the first position, and pump 330 is deactivated. This configuration allows for air to freely flow between atmosphere and the canister via first flow path 320. This configuration may be used during a canister purging operation, for example or during other conditions where the fuel vapor canister is to be vented to atmosphere.

As shown in FIG. 3D, COV 315 is in the second position, and pump 330 is activated in a second direction. This configuration allows for air to be pumped from atmosphere towards the canister via second flow path 325. Pumping air into the evaporative emissions system may be utilized in pressurizing one or more sectors, in dislodging impediments, etc. As described further herein and with regards to FIGS. 4 and 5, in some embodiments, this configuration may be used during an integrity test for the fuel vapor canister heating element.

As the fuel vapor canister is part of the evaporative emissions system, its components may be subject to periodic diagnostic testing. For a canister heating element, canister temperature may be monitored while the heating element is active. However, when the canister heating element is operated during a purge event, the cooling effect of fuel vapor desorption may confound any temperature sensor readings.

FIG. 4 depicts a flow chart for a high level method 400 for discerning the integrity of a fuel vapor canister heating element. Instructions for carrying out method 400 and other methods included herein may be executed by a controller based on instructions stored in non-transitory memory of the controller, and in conjunction with signals received from sensors of the evaporative emissions system, such as the sensors described above with reference to FIG. 2. The controller may employ actuators of the evaporative emissions system to adjust evaporative emissions operation, according to the methods described below. While described with reference to the systems depicted in FIGS. 1, 2, and 3A-3D, it should be understood that method 400 or similar methods may be applied to other systems without departing from the scope of this disclosure.

Method 400 may be executed during an engine-off condition, such as during a vehicle-off condition. In some examples, following an engine-off event, a controller may be placed in a sleep or low-power mode, and awoken following an engine-off soak. The duration of the engine-off soak may be predetermined or based on operating conditions. Method 400 begins at 405. At 405, method 400 includes evaluating operating conditions. Operating conditions may be measured (e.g., using on-board sensors), estimated, and/or inferred, and may include vehicle conditions, such as vehicle speed, vehicle location, vehicle occupancy, etc.; engine conditions, such as engine status, engine speed, engine load, etc.; fuel system conditions, such as fuel level, fuel tank pressure, canister load, etc., ambient conditions, such as ambient temperature, barometric pressure, humidity, etc.; as well as other conditions.

Continuing at 410, method 400 includes determining whether a fuel vapor canister load is below a threshold. The fuel vapor canister load may be measured, estimated, or inferred. For example, canister loading may be determined based on canister temperature change during a fuel tank venting event and/or a refueling event. In some examples, canister loading may be determined based on fuel composition, fuel RVP, fuel tank pressure, a quantity of fuel added during a refueling event, etc. A current canister load may be based on a quantity of fuel vapor desorbed during a canister purge event. Fuel vapor desorption may be determined based on canister temperature, hydrocarbon sensors, A/F ratio, exhaust oxygen levels, etc. The canister load threshold may be predetermined and/or based on operating conditions. The canister load threshold may represent a canister load which is not expected to generate undesired emissions over the course of method 400.

If the canister load is above the threshold, method 400 proceeds to 412. At 412, method 400 includes setting a flag to follow up after a next canister purging event. For example, a code may be stored at a controller that may trigger re-initiation of method 400 following a canister purge event. Method 400 may then end.

If the canister load is below the threshold, method 400 proceeds to 415. At 415, method 400 includes determining whether an engine coolant temperature is within a threshold of an intake air temperature. In this way, it may be determined whether the engine has sufficiently cooled to ambient temperature. Engine coolant temperature may be measured by one or more engine coolant temperature sensors, such as a thermostatic sensor, while intake air temperature may be measured by one or more intake air temperature sensors mounted in an intake passage of the engine, such as IAT 267. If the engine coolant temperature is more than a threshold away from the intake air temperature, method 400 proceeds to 417, and includes sleeping the controller (or placing the controller in a low-power mode), and re-waking the controller following a vehicle-off soak duration.

When the engine coolant temperature is within a threshold of the intake air temperature, method 400 may proceed to 420. At 420, method 400 includes activating a canister heating element. For example, a thermoelectric canister heating element may be turned on in order to heat the interior of the fuel vapor canister. In some examples, wherein the canister heating element comprises a heat transfer mechanism, a thermal carrier may be heated to a threshold temperature, and then circulated through a heat exchanger to warm the canister.

Continuing at 425, method 400 includes closing the FTIV. In some examples, the FTIV (or VBV, etc.) may be a default closed valve, and may thus be maintained in a closed conformation. In other examples, the fuel vapor canister may be decoupled from the fuel tank by any suitable means.

Continuing at 430, method 400 includes activating an ELCM pump in a pressurizing mode. For example, as described with regard to FIG. 3D, an ELCM changeover valve may be actuated to couple the fuel vapor canister to atmosphere via a vacuum pump, and then the vacuum pump may be activated such that atmospheric air is drawn into the canister vent and then pumped towards the fuel vapor canister vent port. In some examples, the ELCM pump may be activated only when the fuel vapor canister heating element has been activated for a duration. The duration may be pre-determined, or based on current operating conditions. In examples wherein the fuel vapor canister heating element is configured to heat purge air (rather than directly heating the canister adsorbent bed), the purge air may be circulated through the heating element for a duration prior to being directed to the fuel vapor canister.

Continuing at 435, method 400 includes opening a throttle valve. For example, an ECT may be opened, such as throttle 262, as shown in FIG. 2. The throttle valve may be placed in a wide-open throttle position, or at an intermediate position. In some examples, the engine intake may be coupled to atmosphere by other suitable means. Continuing at 440, method 400 includes opening a canister purge valve. By opening the canister purge valve, atmospheric air pumped into the fuel vapor canister may be flowed into the engine intake. With the throttle opened, the air flowed into the engine intake will be flowed back to atmosphere without pressurizing the engine intake.

Continuing at 445, method 400 includes determining whether the intake air temperature sensor response is greater than a threshold. In other words, it may be determined whether the air flowed into the engine intake is warmer than atmospheric air, thus indicating that the canister heating element is functional. The IAT threshold may be predetermined, or may be based on current operating conditions (e.g., ambient temperature). The IAT threshold may be a temperature value, a change in temperature, a rate of temperature change, an integrated change in temperature over time, etc. In some embodiments, multiple thresholds may be evaluated. For example, a first threshold may be representative of whether the intake air temperature increased at all, while a second threshold, higher than the first threshold, may be representative of whether the canister heating element is operating at 100% capability. In some examples, mass air flow through the engine intake (e.g., via a MAF sensor) may be determined in order to set the first and/or second thresholds, and may be used to discern whether air is being flowed to the engine intake in the current evaporative emissions system conformation. If the mass air flow is below a threshold, method 400 may be aborted, and additional tests may be indicated to determine whether the ELCM pump is functional, whether there is a blockage in the flow pathway, etc.

If the IAT response is below the threshold, method 400 proceeds to 450, and includes indicating degradation of the canister heating element. Indicating degradation of the canister heating element may include setting a flag at a controller, and may further include indicating degradation to the vehicle operator, e.g., via a dash malfunction indicator lamp. The IAT response may be stored at the controller, and may indicate a degree of degradation (e.g., non-functional, partially functional, etc.). Continuing at 455, method 400 may include adjusting evaporative emissions system parameters. For example, purge conditions may be adjusted to indicate that a greater quantity of purge air flow is necessary to purge the contents of the fuel vapor canister in the absence of a fully functional canister heating element. Adjusting purge conditions may include adjusting purge event entry conditions, such as a minimum engine intake vacuum. Adjusting purge conditions may include adjusting a commanded purge valve duty cycle, which may require adjusting fuel injection parameters to achieve a desired A/F ratio.

If the IAT response is above the threshold, method 400 proceeds to 460, and includes indicating that the canister heating element is functional. Indicating that the canister heating element is functional may include recording the passing test result at the controller. Continuing at 465, method 400 includes adjusting evaporative emissions system testing schedules. For example, a timing of and/or entry conditions for a next canister heating element functionality test may be adjusted. Further, the information gathered during the execution of method 400 may provide an indication of the functionality of other evaporative emissions system elements. For example, the functionality of the ELCM pump may be validated, and the timing of a subsequent ELCM pump test adjusted. Further, restrictions (and/or the absence of restrictions) in the canister vent and canister purge pathways may be indicated, and the timing and/or parameters of subsequent tests adjusted.

When evaporative emissions system parameters and/or testing schedules have been adjusted, method 400 proceeds to 470. At 470, method 400 includes restoring evaporative emissions system actuators to their default configurations. For example, the ELCM vacuum pump may be turned off, and an ELCM COV may be actuated to couple the fuel vapor canister directly to atmosphere. The canister purge valve may be closed, the throttle may be closed, and the FTIV placed in a default condition. The canister heating element, as well as any associated thermal elements may be turned off. The engine controller may then be placed in a sleep/low power mode, depending on operating conditions. Method 400 may then end.

FIG. 5 depicts a timeline 500 for an example fuel vapor canister heating element integrity test using the method described herein and with reference to FIG. 4. Timeline 500 includes plot 505, indicating engine status over time. Timeline 500 further includes plot 510, indicating engine coolant temperature over time, and plot 512, indicating an intake air temperature over time. Plots 510 and 512 are co-plotted on the same axes, with engine coolant temperature represented by a solid line, and with intake air temperature represented by a dashed line. Line 514 represents an intake air temperature threshold for determining the integrity of a fuel vapor canister heating element. Timeline 500 further includes plot 515, indicating a canister load over time. Line 517 represents a canister load threshold for performing a fuel vapor canister heating element integrity test. Timeline 500 further includes plot 520, indicating the status of a canister heating element over time, plot 525, indicating the status of a fuel tank isolation valve over time, and plot 530, indicating the status of a canister purge valve over time. Timeline 500 further includes plot 535, indicating the status of an ELCM COV over time, and plot 540, indicating the status of an ELCM vacuum pump over time. Timeline 500 further includes plot 545, indicating a throttle position over time, and plot 550, indicating whether degradation of the canister heating element is indicated over time.

At time $t_0$, the engine is on, as indicated by plot 505. The canister heating element is off, as indicated by plot 520, the FTIV is closed, as indicated by plot 525, and the canister purge valve is closed, as indicated by plot 530. The ELCM COV is in a venting position, as indicated by plot 535, and the ELCM pump is off, as indicated by plot 540 (see FIG. 3C as an example). The canister has a load that is approaching full capacity, as indicated by plot 515. Accordingly, at time $t_1$, a canister purge event is initiated. The canister heating element is turned on, and the canister purge valve is opened, while the FTIV is maintained closed and the ELCM is maintained in its current configuration. Opening the canister purge valve causes atmospheric air to be drawn through the fuel vapor canister, desorbing the stored fuel vapor to the engine intake for combustion. Accordingly, the canister load decreases until time $t_2$, when the canister purge valve is closed, and the canister heating element is turned off.

At time $t_3$, the engine is turned off, and the throttle is placed in a closed position, as shown by plot 545. The engine coolant temperature is significantly higher than the intake air temperature, as shown by plots 510 and 512, respectively. The engine is maintained off from time $t_3$ to time $t_4$. Accordingly, the engine coolant temperature decreases, and at time $t_4$, the engine coolant temperature is within a threshold of the intake air temperature, thus satisfying an entry condition for a canister heating element integrity test (see 415 of FIG. 4). Further, the canister load is below the threshold represented by line 517, satisfying an additional entry condition (see 410 of FIG. 4). As such, the canister heating element is turned on, and a threshold for intake air temperature is set, as represented by line 514.

At time $t_5$, the canister heating element is maintained on, while the FTIV is maintained closed. Further, the ELCM COV is placed in a restricting position, coupling the canister to atmosphere via the ELCM pump, which is turned on in a pressure mode, drawing atmospheric air into the canister vent. The canister purge valve is opened thereby directing the pumped air to engine intake, and the throttle is opened, venting the engine intake to atmosphere. As shown by plot 510, the intake air temperature increases, as the heated air is pumped in to the engine intake. However, the intake air fails to reach the threshold represented by line 514, reaching a plateau at time $t_6$. As such, degradation of the canister heating element is indicated, as indicated by plot 550. The evaporative emissions system is then restored to a default configuration. The canister heating element is turned off, the ELCM COV is placed in a venting position, and the ELCM pump is turned off. The canister purge valve and throttle are closed, and the FTIV is maintained closed.

The systems described herein and with reference to FIGS. 1, 2, and 3A-3D, along with the methods described herein and with reference to FIG. 4 may enable one or more systems and one or more methods. In one example, a method is presented, comprising: during a first condition, including an engine-off condition, activating a fuel vapor canister heating element; directing atmospheric air through the fuel vapor canister and into an engine intake; and indicating degradation of the fuel vapor canister heating element based on an output of an engine intake air temperature sensor. In such an example, the method may additionally or alternatively comprise adjusting an evaporative emissions system parameter responsive to an indication of degradation of the fuel vapor canister heating element. In any of the preceding examples, adjusting an evaporative emissions system parameter may additionally or alternatively include increasing a commanded total airflow through the fuel vapor canister during a subsequent purge event. In any of the preceding examples, the first condition may additionally or alternatively include a canister load below a threshold. In any of the preceding examples the first condition may additionally or alternatively include an engine coolant temperature within a threshold of an intake air temperature. In any of the preceding examples, directing atmospheric air through the fuel vapor canister may additionally or alternatively include activating a vacuum pump coupled between the fuel vapor canister and atmosphere. In any of the preceding examples, the method may additionally or alternatively comprise coupling the fuel vapor canister to atmosphere via the vacuum pump; and activating the vacuum pump in a conformation to draw atmospheric air into the fuel vapor canister. In any of the preceding examples, directing atmospheric air through the fuel vapor canister and into an engine intake may additionally or alternatively comprise opening a canister purge valve coupled between the fuel vapor canister and the engine intake. In any of the preceding examples, directing atmospheric air through the fuel vapor canister and into an engine intake may additionally or alternatively comprise closing a fuel tank isolation valve coupled between the fuel vapor canister and a fuel tank. In any of the preceding examples, directing atmospheric air through the fuel vapor canister and into an engine intake may additionally or alternatively comprise opening a throttle coupled between the engine intake and atmosphere. In any of the preceding examples indicating degradation of the fuel vapor canister heating element based on an output of an engine intake air temperature sensor may additionally or alternatively comprise indicating degradation of the fuel vapor canister heating element responsive to an increase in intake air temperature below a threshold. In any of the preceding examples, the method may additionally or alternatively comprise indicating functionality of the fuel vapor canister heating element responsive to an increase in intake air temperature greater than the threshold. In any of the preceding examples, the method may additionally or alternatively comprise updating an evaporative emissions system test schedule responsive to an indication of functionality of the fuel vapor canister heating element. The technical result of implementing this method is a decrease in undesired evaporative emissions without adding additional cost or complexity to the evaporative emissions system, as no additional components are needed to determine the integrity of the fuel vapor canister heating element.

In another example, a system for an engine is presented, comprising: a fuel vapor canister; a canister heating element coupled to the fuel vapor canister; an intake air temperature sensor coupled within an engine intake; an engine coolant temperature sensor; a vacuum pump coupled between the fuel vapor canister and atmosphere; and a controller configured with instructions stored in non-transitory memory, that when executed, cause the controller to: during a first condition, including a fuel vapor canister load below a threshold and an intake air temperature within a threshold of an engine coolant temperature, activating the canister heating element; activating the vacuum pump to flow atmospheric air through the fuel vapor canister; and indicating degradation of the fuel vapor canister heating element responsive to a change in intake air temperature less than a threshold. In such an example, the system may additionally or alternatively comprise a canister purge valve coupled between the fuel vapor canister and the engine intake, and the controller may additionally or alternatively be configured with instructions stored in non-transitory memory, that when executed, cause the controller to: open the canister purge valve to flow pumped atmospheric air into the engine intake. In any of the preceding examples, the vacuum pump may be additionally or alternatively operable to flow atmospheric air through the fuel vapor canister in a first conformation, and to draw a vacuum on the fuel vapor canister in a second conformation. In any of the preceding examples, the first condition may additionally or alternatively include a vehicle-off condition. In any of the preceding examples, the controller may additionally or alternatively be configured with instructions stored in non-transitory memory, that when executed, cause the controller to: during a second condition, including an engine coolant temperature greater than an intake air temperature by more than a threshold, placing the controller in a sleep mode for a duration; waking the controller; and activating the canister heating element responsive to an intake air temperature within a threshold of an engine coolant temperature. The technical effect of implementing this system is that fuel vapor canister function can be monitored without relying on thermocouples within the canister adsorbent bed. By eliminating the need for canister thermocouples, the confounding cooling effect during canister purging is eliminated when determining the integrity of the fuel vapor canister heating elements. In this way, heating element function can be monitored accurately and evaporative emissions system parameters adjusted appropriately if the heating element shows signs of degradation or reduced functionality.

In yet another example, a method for an evaporative emissions system is presented, comprising: following a vehicle-off condition, responsive to a fuel vapor canister load less than a threshold and an engine coolant temperature within a threshold of an engine intake air temperature, activating a fuel vapor canister heating element; isolating a fuel vapor canister from a fuel tank; coupling the fuel vapor canister to atmosphere via an evaporative leak check module vacuum pump; activating the evaporative leak check module pump in a conformation to pump atmospheric air into the fuel vapor canister; opening a canister purge valve; opening an air intake throttle; indicating degradation of the fuel vapor canister heating element responsive to a change in intake air temperature less than a threshold; and adjusting one or more evaporative emissions system parameters responsive to an indication of degradation of the fuel vapor canister heating element. In such an example, the method may additionally or alternatively comprise indicating functionality of the fuel vapor canister heating element responsive to a change in intake air temperature greater than a threshold; and updating one or more evaporative emissions system testing schedules. The technical effect of implementing this method is that a canister heating element may be monitored according to OBD standards without requiring additional components that would themselves need to be tested for functionality. This reduces evaporative emissions system complexity without also reducing performance.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during a first condition, including an engine-off condition, activating a fuel vapor canister heating element;

directing atmospheric air through a fuel vapor canister and into an engine intake; and indicating degradation of the fuel vapor canister heating element based on an output of an engine intake air temperature sensor.

2. The method of claim 1, further comprising:

responsive to an indication of degradation of the fuel vapor canister heating element, adjusting an evaporative emissions system parameter.

3. The method of claim 2, wherein adjusting an evaporative emissions system parameter includes increasing a commanded total airflow through the fuel vapor canister during a subsequent purge event.

4. The method of claim 1, wherein the first condition includes a canister load below a threshold.

5. The method of claim 1, wherein the first condition includes an engine coolant temperature within a threshold of an intake air temperature.

6. The method of claim 1, wherein directing atmospheric air through the fuel vapor canister includes activating a vacuum pump coupled between the fuel vapor canister and atmosphere.

7. The method of claim 6, further comprising:

coupling the fuel vapor canister to atmosphere via the vacuum pump; and activating the vacuum pump in a conformation to draw atmospheric air into the fuel vapor canister.

8. The method of claim 1, wherein directing atmospheric air through the fuel vapor canister and into an engine intake comprises:

opening a canister purge valve coupled between the fuel vapor canister and the engine intake.

9. The method of claim 8, wherein directing atmospheric air through the fuel vapor canister and into an engine intake further comprises:

closing a fuel tank isolation valve coupled between the fuel vapor canister and a fuel tank.

10. The method of claim 8, wherein directing atmospheric air through the fuel vapor canister and into an engine intake further comprises: opening a throttle coupled between the engine intake and atmosphere.

11. The method of claim 1, wherein indicating degradation of the fuel vapor canister heating element based on an output of an engine intake air temperature sensor comprises indicating degradation of the fuel vapor canister heating element responsive to an increase in intake air temperature below a threshold.

12. The method of claim 11, further comprising:

indicating functionality of the fuel vapor canister heating element responsive to an increase in intake air temperature greater than the threshold.

13. The method of claim 12, further comprising:

responsive to an indication of functionality of the fuel vapor canister heating element, updating an evaporative emissions system test schedule.

14. A system for an engine, comprising:

a fuel vapor canister;

a fuel vapor canister heating element coupled to the fuel vapor canister;

an intake air temperature sensor coupled within an engine intake;

an engine coolant temperature sensor;

a vacuum pump coupled between the fuel vapor canister and atmosphere; and a controller configured with instructions stored in non-transitory memory, that when executed, cause the controller to:

during a first condition, including a fuel vapor canister load below a threshold and an intake air temperature within a threshold of an engine coolant temperature, activating the fuel vapor canister heating element;

activating the vacuum pump to flow atmospheric air through the fuel vapor canister; and indicating degradation of the fuel vapor canister heating element responsive to a change in intake air temperature less than a threshold.

15. The system of claim 14, further comprising a canister purge valve coupled between the fuel vapor canister and the engine intake, and wherein the controller is further configured with instructions stored in non-transitory memory, that when executed, cause the controller to:

open the canister purge valve to flow pumped atmospheric air into the engine intake.

16. The system of claim 14, wherein the vacuum pump is operable to flow atmospheric air through the fuel vapor canister in a first conformation, and to draw a vacuum on the fuel vapor canister in a second conformation.

17. The system of claim 14, wherein the first condition includes a vehicle-off condition.

18. The system of claim 14, wherein the controller is further configured with instructions stored in non-transitory memory, that when executed, cause the controller to:

during a second condition, including an engine coolant temperature greater than an intake air temperature by more than a threshold, place the controller in a sleep mode for a duration;

wake the controller; and activate the fuel vapor canister heating element responsive to an intake air temperature within a threshold of an engine coolant temperature.

19. A method for an evaporative emissions system, comprising:

following a vehicle-off condition, responsive to a fuel vapor canister load less than a threshold and an engine coolant temperature within a threshold of an engine intake air temperature, activating a fuel vapor canister heating element;

isolating a fuel vapor canister from a fuel tank;

coupling the fuel vapor canister to atmosphere via an evaporative leak check module vacuum pump;

activating the evaporative leak check module vacuum pump in a conformation to pump atmospheric air into the fuel vapor canister;

opening a canister purge valve;

opening an air intake throttle;

indicating degradation of the fuel vapor canister heating element responsive to a change in intake air temperature less than a threshold; and adjusting one or more evaporative emissions system parameters responsive to an indication of degradation of the fuel vapor canister heating element.

20. The method of claim 19, further comprising:

indicating functionality of the fuel vapor canister heating element responsive to a change in intake air temperature greater than a threshold; and updating one or more evaporative emissions system testing schedules.

* * * * *